United States Patent [19]

Barr et al.

[11] Patent Number: 4,727,946

[45] **Date of Patent: * Mar. 1, 1988**

[54] ROTARY DRILL BITS

[75] Inventors: John D. Barr, Cheltenham; Terry R. Matthias, Gloucester, both of England

[73] Assignee: NL Industries, Inc., New York, N.Y.

[ * ] Notice: The portion of the term of this patent subsequent to Jun. 24, 2003 has been disclaimed.

[21] Appl. No.: 876,847

[22] Filed: Jun. 20, 1986

Related U.S. Application Data

[63] Continuation-in-part of Ser. No. 665,071, Oct. 26, 1984.

[51] Int. Cl.[4] ..... E21B 10/60

[52] U.S. Cl. ..... 175/379; 175/340; 175/393

[58] Field of Search ..... 175/339, 340, 379, 393, 175/331, 410

[56] References Cited

U.S. PATENT DOCUMENTS

| | | | |
|---|---|---|---|
| 3,384,191 | 5/1968 | Schumacher et al. | 175/340 |
| 4,105,083 | 8/1978 | Allen | 175/340 |
| 4,200,160 | 4/1980 | Newcomb | 175/340 |
| 4,363,367 | 12/1982 | Dixon et al. | 175/340 |
| 4,505,342 | 3/1985 | Barr et al. | 175/410 |
| 4,577,706 | 3/1986 | Barr | 175/393 |
| 4,596,296 | 6/1986 | Matthias | 175/379 |

*Primary Examiner*—James A. Leppink
*Assistant Examiner*—Terry Lee Melius
*Attorney, Agent, or Firm*—Browning, Bushman, Zamecki & Anderson

[57] ABSTRACT

A rotary drill bit, for drilling wells in subsurface earth formations, and designed for rotation in a given direction, comprises a bit body having an internal passageway for drilling fluid. The bit body has an operating end face and at least one opening through that face communicating with the passageway. Cutters on the bit body form at least one elongate cutting region extending generally radially along a substantial portion of the operating end face. The cutters have cutting surfaces facing in the forward direction and generally continuous cutting edges at the outer extremity of the cutting surfaces. An elongate fence is carried on the bit body, extending generally parallel to the cutting region and spaced from the cutting region in a leading direction. The fence is adapted to ride loosely over the earth formation in use and in the absence of a positive pressure differential across the fence rear to front, and to more tightly engage the earth formation in the presence of such positive pressure differential, tightness of engagement increasing with the pressure differential. The opening in the operating end face of the bit body is positioned to deliver drilling fluid from the passageway to the area between the cutting region and the fence.

20 Claims, 16 Drawing Figures

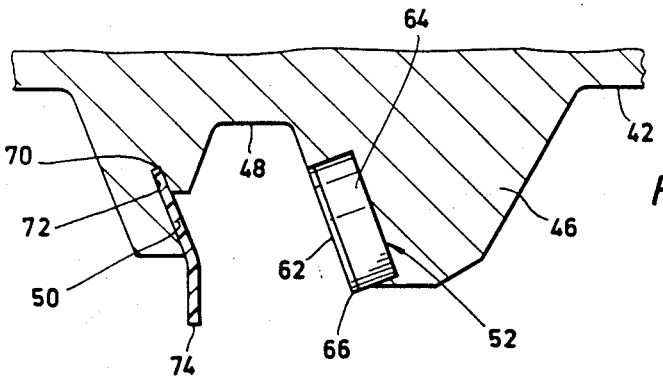
FIG. 11
FIG. 12
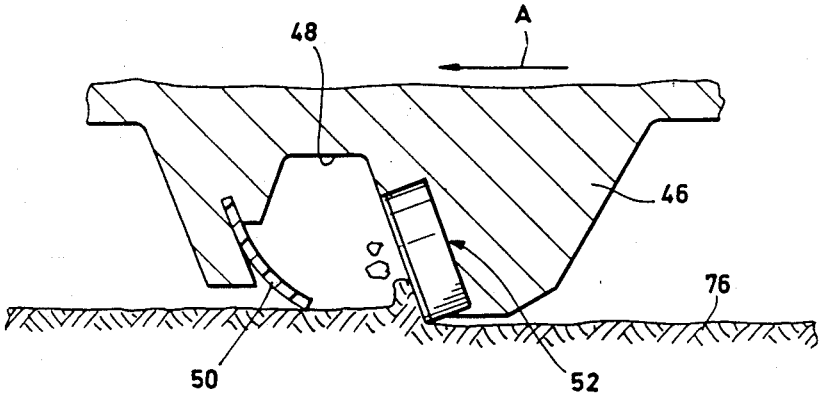
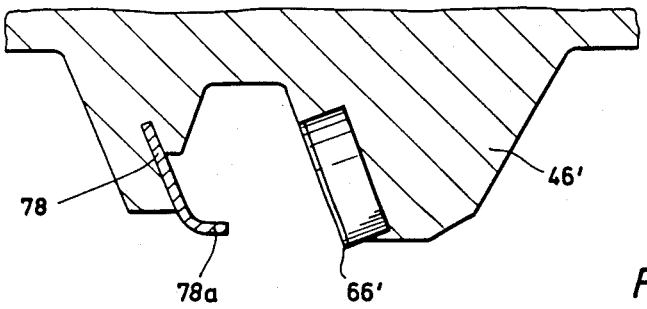
FIG. 14

FIG. 15
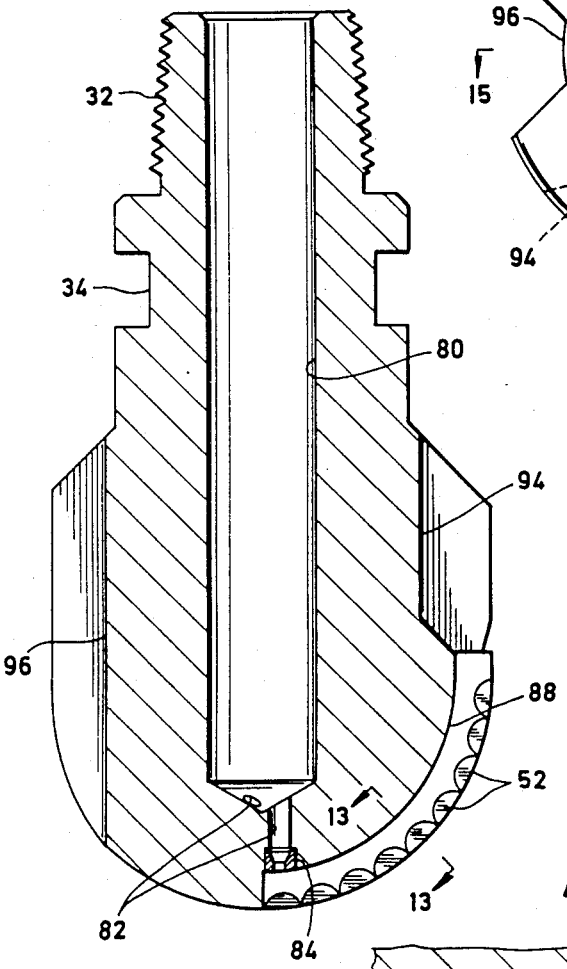
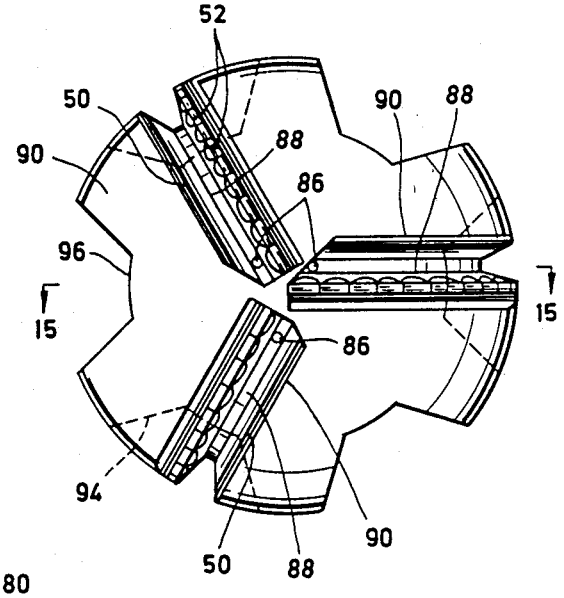
FIG. 16
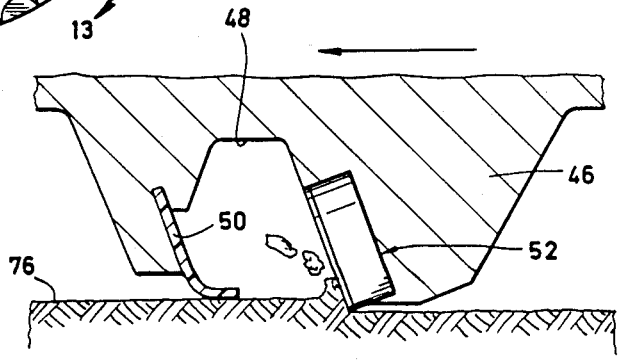
FIG. 13

ROTARY DRILL BITS

CROSS REFERENCE TO RELATED APPLICATION

This application is a continuation-in-part of co-pending U.S. patent application Ser. No. 665,071 filed Oct. 26, 1984.

BACKGROUND OF THE INVENTION

The invention relates to rotary drill bits and in particular to bits which are used to drill wells in rock or other subsurface earth formations, for example to extract oil, gas or water, or in mining.

The invention relates to drill bits of the kind comprising a bit body, for connection to a drill string, a passageway for drilling fluid within the body, which passageway communicates with one or more openings in an external surface of the body, cutting elements mounted on the external surface of the body for cutting or abrading the formation, and one or more elongate fences upstanding from the external surface of the body to control the flow of fluid from said opening or openings and past said elements. Prior art fences have typically been rigid. The flow of fluid, controlled by said fences, serves to carry away cuttings and chippings removed from the formation by the cutting elements and also to cool the elements and the formation being drilled.

The cutting elements may be polycrystalline diamond compacts and may be arranged in rows alongside wall portions of channels or grooves provided in the surface of the bit. The fences are spaced from the cutting elements and may extend substantially parallel to the channels or grooves so as to control the flow of fluid along the blades and past the cutting elements.

It is desirable that the free edge of each fence remote from the bit surface should sealingly engage the formation so as to prevent flow of fluid across the fence, since this would reduce the flow of fluid past the cutting elements. However, the formation being drilled will usually be of varying hardness and this affects the quality of the seal between the fence and the formation. During drilling through formation of a fairly consistent hardness the free edge of the fence engaging the formation will be worn away to an extent depending on the depth of cut of the cutting elements and will form an effective seal with the formation. However, if the drill bit then enters formation of greater hardness, the depth of cut of the cutting elements will immediately be reduced with the effect that the fence will no longer sealingly engage the formation. Flow can then occur across the fence, leading to inefficient cooling and carrying away of cuttings and chippings. Furthermore, the rubbing engagement between the fences and the formation provides significant resistance to the rotation of the drill.

The present invention sets out to provide an improved form of rotary drill bit in which these disadvantages may be overcome.

SUMMARY OF THE INVENTION

According to the invention, there is provided a rotary drill bit, for drilling wells in subsurface formations, and designed for rotation in a given direction comprising a bit body having an internal passageway for drilling fluid, an operating end face, and at least one opening through the operating end face communicating with the passageway. Cutting elements are mounted on the body for cutting or abrading the formation, and one or more elongate fences carried on the bit body control the flow of fluid from such openings and past said cutting elements.

In one embodiment of the invention, each fence is resiliently deformable so that, in use, the free elongate edge thereof is urged resiliently into contact with the surface of the formation being cut or abraded by the cutting elements. Since each frame is resiliently deformable, it will at all times firmly engage the formation to provide an effective seal, regardless of variations in depth of cut of the cutting elements or hardness of the formation. Such a resiliently deformable fence may be in the form of an elongate brush having resilient bristles extending away from the surface of the bit body.

The cutting elements are typically arranged in several rows radiating across the operating end face of the bit. It is desirable to prevent substantial fluid leakage in both forward and rearward directions (with respect to the direction of rotation) so that the fluid will flow mainly radially along the rows of cutting elements.

Where a fence in trailing relation to a row of cutting elements is used to prevent rearward leakage, it is desirable that the fence be both deformable (or flexible) and resilient so that it can seal against the formation. However, since rotation of the bit causes the free edge of the flexible fence to bend rearwardly, i.e. away from the area in which fluid is to be constrained, there may still be an unacceptable amount of rearward fluid leakage.

Furthermore, even which such a trailing fence does seal acceptably, the stiffness or resistance to bending necessary to enable such sealing also causes the fence to bear hard against the formation at all times, making it more susceptible to wear and increasing the friction between the bit and the formation.

These problems are addressed by another embodiment of the invention in which the cutting elements in each row are disposed so close to one another that they jointly define a generally continuous cutting edge. The continuity of this edge enables it to effectively form its own seal against rearward leakage, whereby a trailing fence can be eliminated.

A flexible fence is disposed in leading relation to the row of cutting elements. Again, the rotation of the bit will cause the free edge of the fence to bend rearwardly, but in the case of a leading fence, such bending takes the fence edge inwardly toward the channel or other area in which fluid is to be constrained.

This makes the leading fence a self-actuating seal. Sealing is most needed when pressure between the fence and the row of cutting elements is high. For example, when a blockage occurs in the channel between the cutters and fence, the area should be sealed to allow fluid pressure therein to increase until it clears the blockage. As the pressure increases, it urges the inturned edge of the leading fence harder against the formation, so that the tightness of the seal is increased by the very pressure being sealed against.

An important implication of this arrangement is that, since the fluid pressure supplies the necessary sealing force on the leading fence, that fence need not be designed to exert a substantial force of its own against the formation. Thus, when there is no blockage, the fence is not urged against the formation with unnecessary force and prematurely worn.

Another advantage of this arrangement is that, since flexible fences are used only as leading seals, and such seals are self-actuating, the structure of the fence itself can be simplified. More specifically, where a fence is in the form of a brush, as in the first embodiment described above, there are a plurality of resiliently deformable elements disposed adjacent one another in a direction across the width of the fence. This provides much greater total strain energy, so that even a trailing fence can maintain a useful pressure difference, even though that fence is flared away from the cutters in a trailing direction in use. In effect, there may be a series of small, incremental pressure drops across the fence, resulting in a significant total pressure drop from one side of the fence to the other. However, in the embodiment in which fences are used only as leading, self-actuating seals, this becomes unnecessary, and a more simple fence, e.g. a single continuous strip of flexible material, may be used as the fence. This in turn can also simplify the procedure necessary for mounting the fence on the bit body.

In any of the above arrangements, each cutting element preferably includes, in known manner, a thin hard facing layer and a thicker, less hard, backing layer so that the cutting element is self-sharpening.

A principal object of the present invention is to provide a well drilling bit in which a fence in leading relation to a cutting region of the bit is adapted to act as a self-actuating seal against fluid flow in the direction from the cutting region across the fence.

Another object of the present invention is to provide such a bit in which the cutting region has a generally continuous cutting edge extending radially along a substantial portion of the operating end face of the bit.

Still another object of the present invention is to provide such a bit in which the leading fence is flexible.

A further object of the present invention is to provide such a bit in which the leading fence is adapted to ride loosely over the formation in the absence of a positive pressure differential thereacross from the direction of the associated cutting region.

Still other objects, features and advantages of the invention will be made apparent by the following detailed description, the drawings and the claims.

BRIEF DESCRIPTION OF THE DRAWINGS

FIG. 11 is an enlarged detailed sectional view taken on the line 11—11 in FIG. 9;

FIG. 12 is a view similar to that of FIG. 11 but showing the apparatus in operation and in the absence of a large pressure differential across the fence;

FIG. 13 is a view similar to those of FIG. 11 and 12 showing the apparatus in the presence of a large pressure differential across the fence;

FIG. 14 is a view similar to that of FIG. 11 showing another form of fence;

FIG. 15 is a view similar to that of FIG. 9 showing another embodiment of bit according to the present invention, and taken along the line 15—15 in FIG. 16; and FIG. 16 is an elevational view of the operating end face of the bit of FIG. 15.

DETAILED DESCRIPTION OF THE PREFERRED EMBODIMENT

Figure 1:
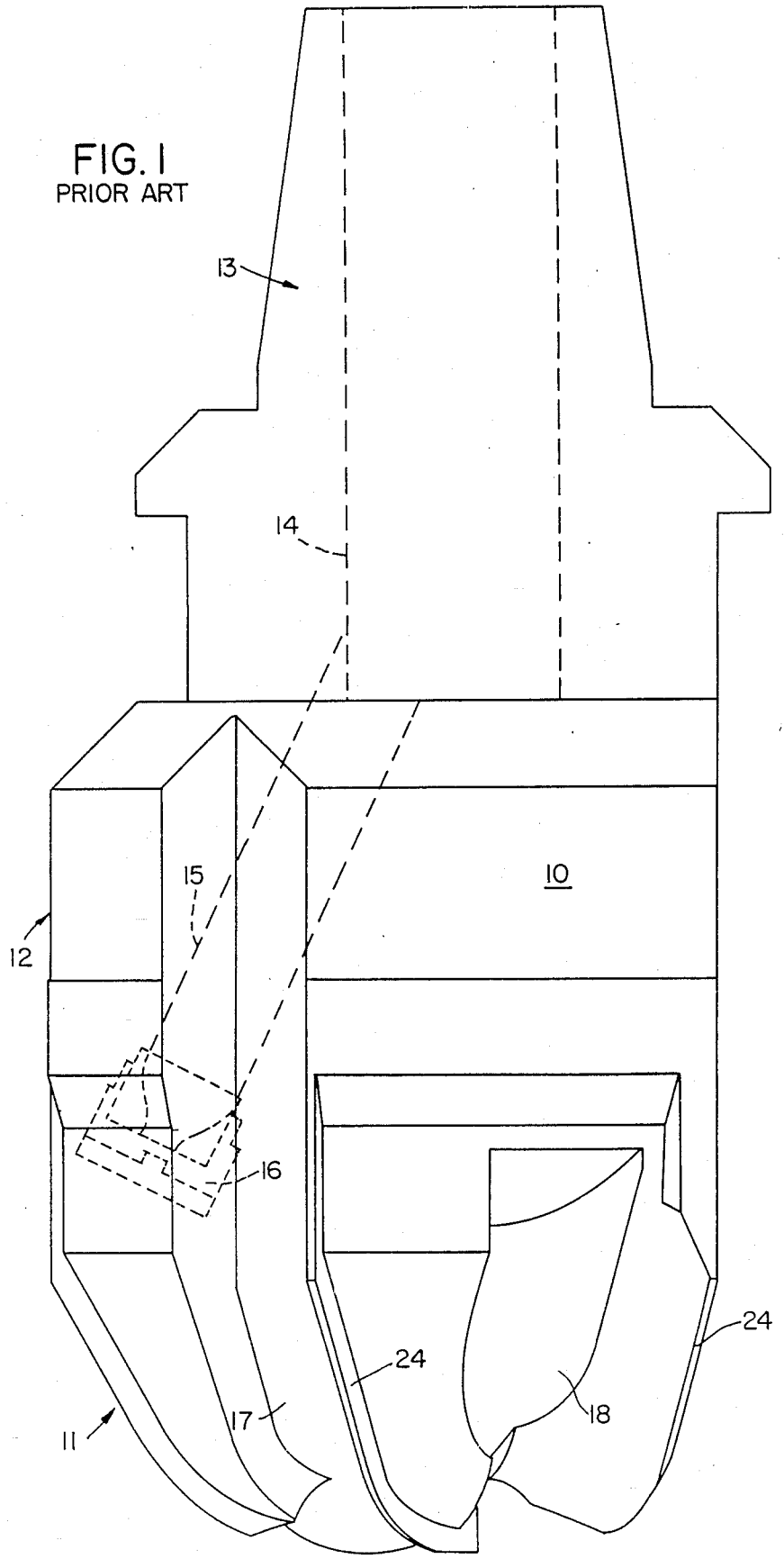
FIG. 1 PRIOR ART
FIG. 1 is a diagrammatic side elevation of a known drill bit of the basic kind to which the invention relates.

Referring to FIG. 1, the rotary drill bit body 10 comprises a lower operating end face 11, a gauge portion 12 and an upper end portion 13 for connection to a drill string, not shown.

A central bore 14 extends through the end portion 13 and ends inside the bit. A number of passageways 15 of reduced diameter lead from the bore 14 to the periphery of the end face 11 where they communicate with outlet nozzles 16.

A number of grooves or channels 17 and 18 are formed in the surface of the bit, and extend outwardly and upwardly from the center of the operating end face 11. Six such channels are provided in the arrangement shown. Alternate channels 17 extend upwardly through the gauge portion 12 whereas the other channels 18 terminate adjacent the outer periphery of the operating end face 11. In the arrangement shown, there are provided three outlet nozzles 16 each being disposed adjacent one of the shorter channels 18.

Figure 2:
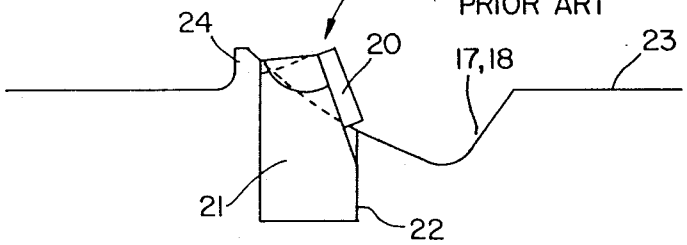
FIG. 2 PRIOR ART
FIG. 2 is a section through a cutting element showing a typical mounting thereof in a known form of bit.

FIG. 2 shows one of the channels 17 in cross section. Spaced apart along one side of each channel are a plurality of cutting elements 19. (The cutting elements 19 are omitted from FIG. 1.)

Each cutting element 19 comprises, in known manner, a circular polycrystalline diamond compact 20 which is mounted on a stud 21 which is received within a circular socket 22 in the bit body. As best seen in FIG. 2, the compact 20 projects beyond the surface 23 of the bit body.

When the drilling bit is in use, drilling mud is pumped down the bore 14, flows along the passageways 15 and exits through the nozzles 16. As the bit is rotated, the cutting elements 18 cut or abrade the formation, producing chippings. The drilling mud from the nozzles 16 flows along the channels 17 and 18 and past the cutting elements so as to clear away the chippinigs and cool the formation and the cutting elements. In the particular arrangement shown, mud from each nozzle 16 first flows inwardly and downwardly along the channels 18 before returning outwardly and upwardly along the channels 17.

In order to control the flow of drilling mud along the channels, fences are provided along the rearward side of each row of cutting elements with respect to the direction of rotation of the bit. A known fence arrangement is shown in FIGS. 1 and 2, where a rigid elongate fence 24 is formed integrally with the bit body and projects from the surface thereof.

In use of the bit, the purpose of the fence 24 is to engage the surface of the formation to the rear of the cutting elements and to form a seal against the formation, thus containing the drilling mud within the channels 17, 18 so that it flows past the cutting elements. In practice, however, as previously explained, when drilling through formations of varying hardness, the situation can arise where the fence does not firmly engage the surface of the formation and leakage from the channels 17, 18 across the fence can occur, to the detriment of the cooling and clearing efficiency of the mud flow.

Figure 3:
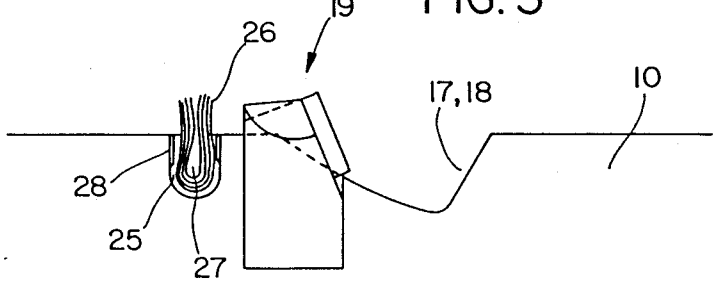
FIG. 3 is a similar view to FIG. 2 through a cutting element and its mounting in a drill bit according to the invention.
Figure 4:
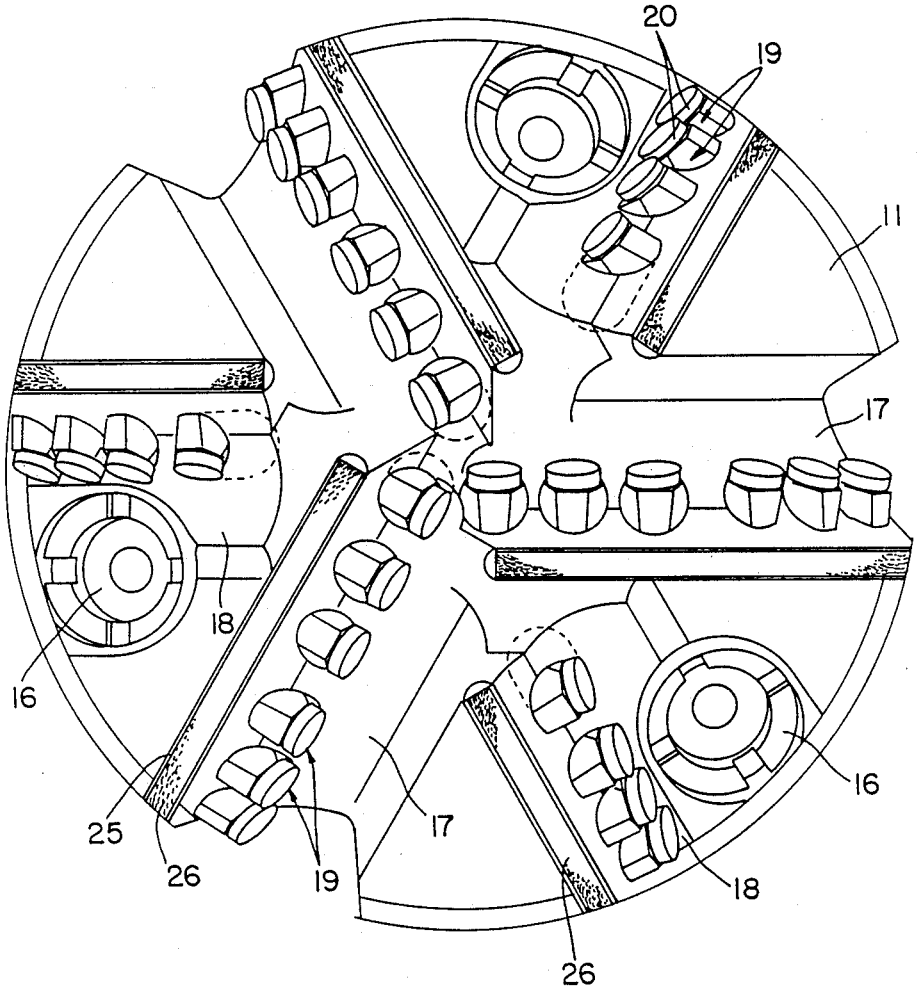
FIG. 4 is an end elevation of a drill bit according to the invention.

The present invention overcomes this problem by providing resiliently deformable fences and, in the embodiment shown in FIGS. 3 and 4, there are provided fences in the form of elongate brushes with metal bristles.

As best seen in FIG. 3, each fence comprises a generally channel-shaped metal element 25, the side walls of which are crimped on to stainless steel bristles 26 which are wrapped around a rod 27 extending the length of the channel. The brush is secured within a channel 28 formed in the surface of the bit body 10, for example by brazing.

Figure 5:
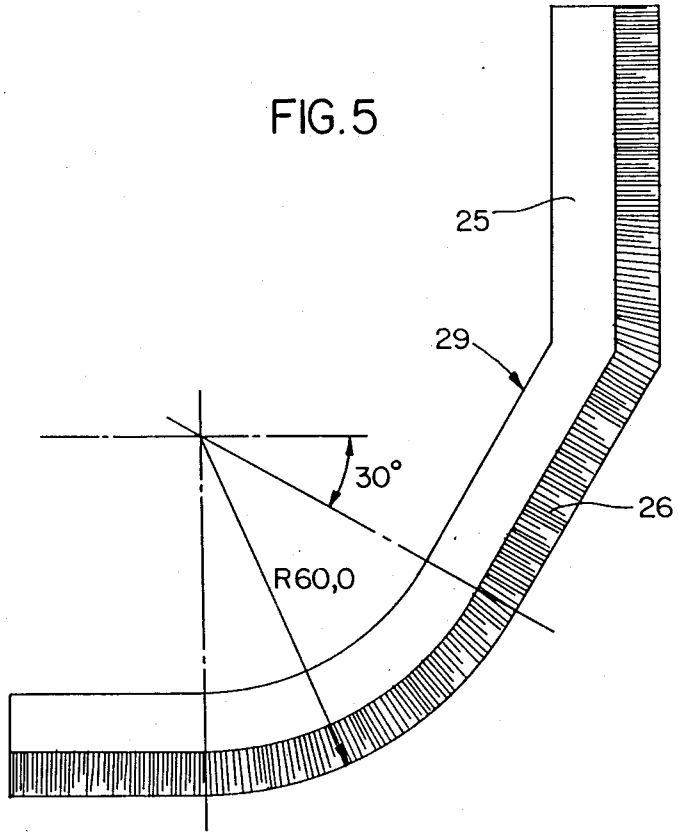
FIG. 5 is a side elevation of a brush element for use in the invention.

FIG. 5 is a side elevation of a brush element 29 of such a shape and size as to extend alongside one of the longer channels 17 in the bit body.

Since the bristles 26 of the brush element are resiliently deformable, they are urged by their resilience into engagement with the formation behind the cutting elements 19 and therefore provide an effective seal regardless of variations in the hardness of the formation and in the cutting depth of the cutting elements. The engagement of the bristles 26 with the formation may also provide less drag to oppose rotation of the bit than the known rigid fences of the kind shown in FIG. 2.

In use the brush elements will tend to clog with drilling debris, enhancing their sealing effect.

Figure 6:
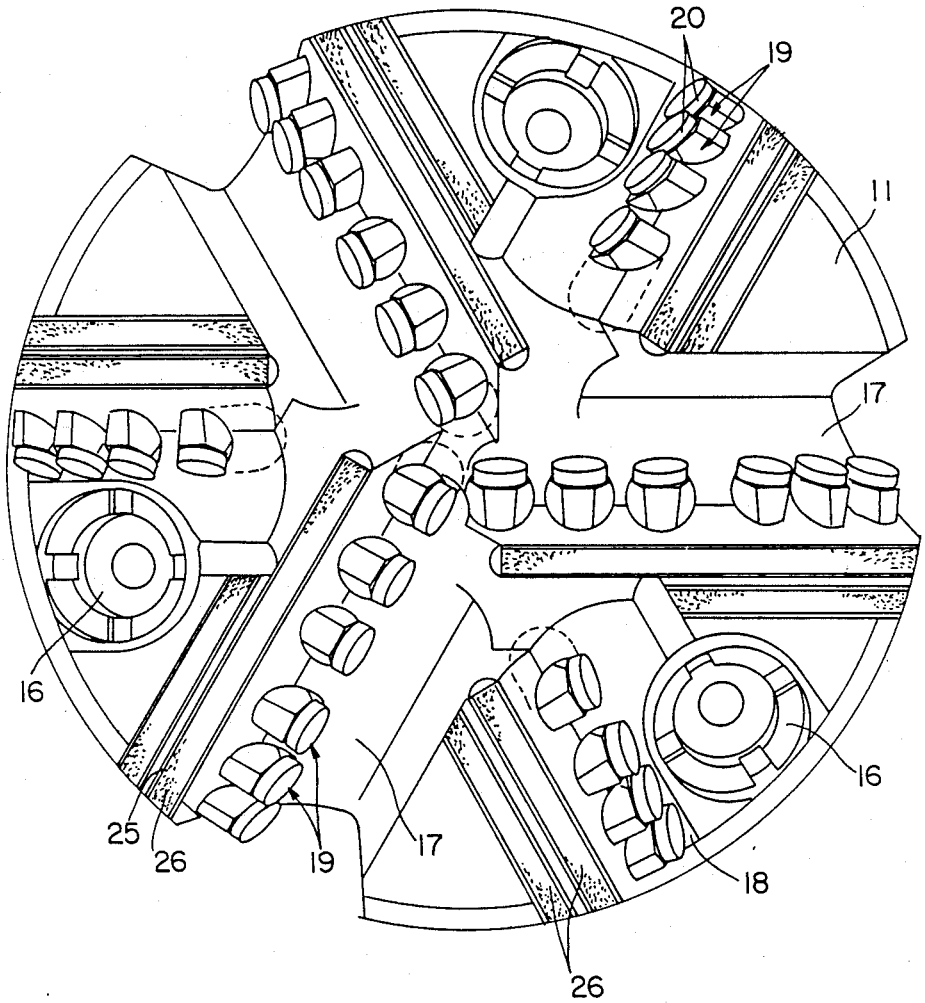
FIGS. 6–8 are similar view to FIG. 4 showing alternative embodiments of the invention.

The sealing effect may be enhanced by providing two elongate brushes in parallel behind each set of cutting elements, as shown in FIG. 6. This provides two pressure drops thus reducing the possibility of leakage past the brushes.

Figure 7:
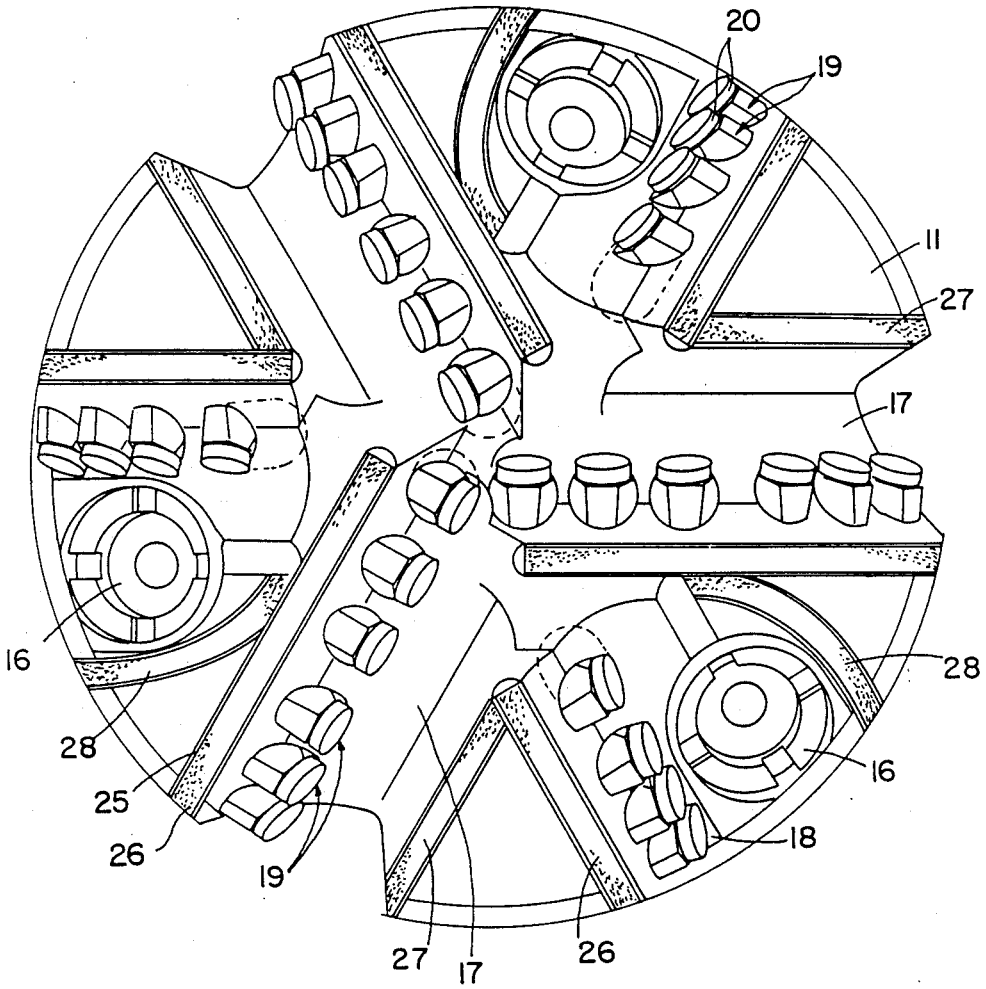

In the alternative arrangement shown in FIG. 7, an elongate brush element 27, similar in construction to the previously described elements 25, 26, is disposed along the opposite side of each channel 17 so as to act as a fence which restricts the flow of drilling fluid along the channel 17 and thus maintains the velocity of the fluid past the cutting elements. Curved elongate brush elements 28 may also be mounted along the sides of the nozzles 16 opposite the cutting elements 19, as is also shown in FIG. 7.

Figure 8:
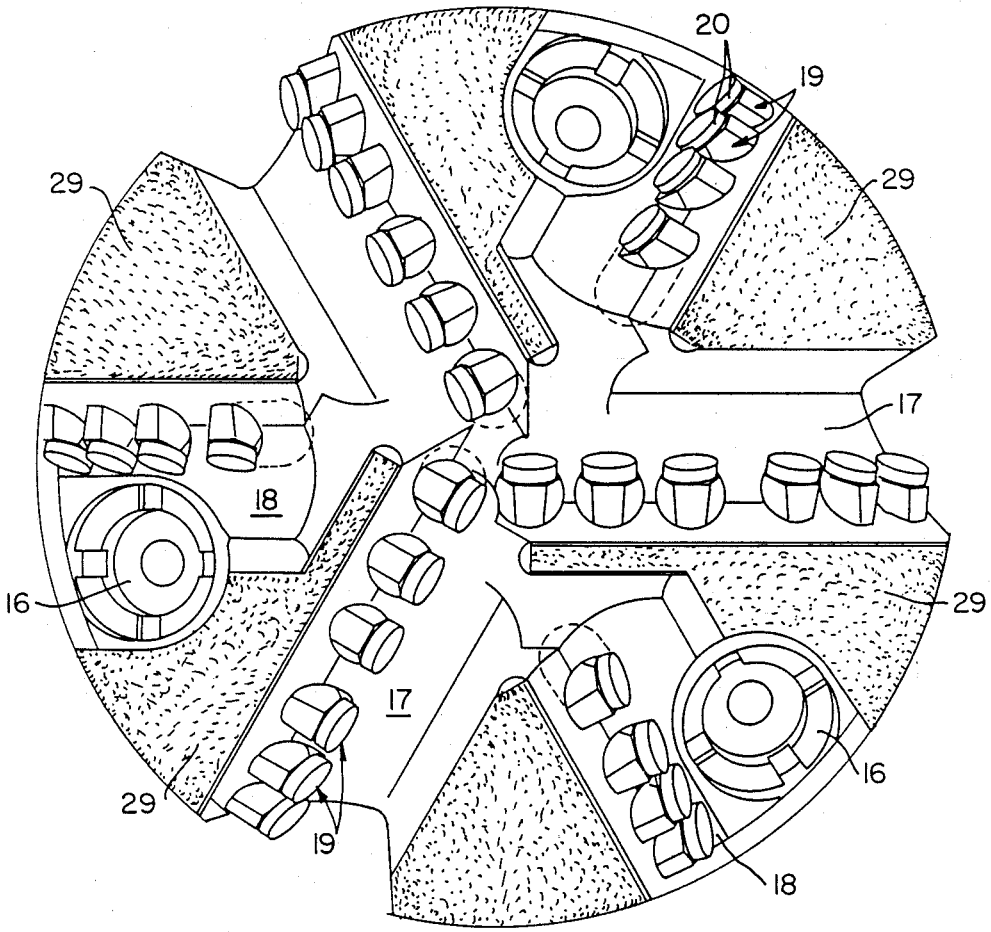

Similar control of the fluid flow and maintenance of the velocity of fluid flow past the cutting elements is also achieved by the alternative arrangement shown in FIG. 8 in which the elongate brush elements of FIG. 7 are replaced by larger brush elements which extend over larger areas of the surface of the bit body so as to provide shaped brush-like rubbing pads as indicated at 29 in FIG. 8. As well as providing sealing, these rubbing pads channel the drilling fluid from the nozzles 16 past the cutting elements.

As previously mentioned, the cutting elements are preferably of the self-sharpening type comprising a thin, hard facing layer and a thicker, less hard backing layer. Since the backing layer is less hard than the facing layer, it tends, in use, to wear away more quickly than the facing layer to give a self-sharpening effect.

The arrangements described above with relation to FIGS. 3–8 are by way of example only, and it will be appreciated that alternative arrangements of the cutting elements, nozzles and fences may be provided. For example, it may not be necessary for the brush elements to extend as far toward the center of the end face of the drill bit as shown in FIG. 4. The bristles may be formed from any suitable material, including synthetic plastics material, and other methods may be employed for anchoring the bristles to the bit body. The invention is also not limited to brush-like elements, but includes within its scope the use of strips of solid resilient material anchored to the bit body, such as strips of rubber, synthetic rubber or other synthetic resilient plastics material. The invention is also not limited to drill bits in which the cutting elements are polycrystalline diamond compacts, but may be applied to drill bits using natural or synthetic diamonds or any other type of cutting element.

Figure 9:
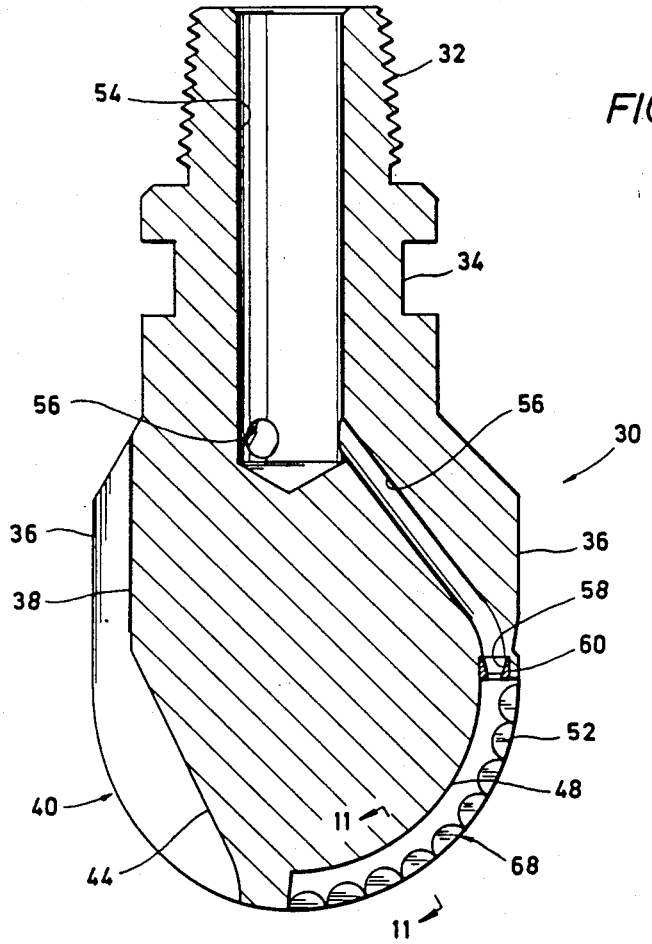
FIG. 9 is a longitudinal cross-sectional view through another embodiment of drill bit according to another aspect of the invention, taken along line 9—9 in FIG. 10.
Figure 10:
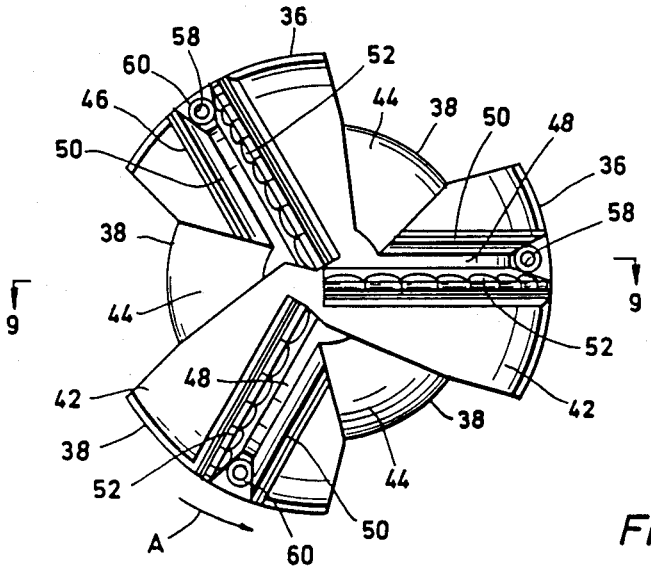
FIG. 10 is an elevation view of the operating end face of the bit of FIG. 9.

Turning to FIGS. 9 and 10, there is shown a drill bit incorporating further improvements according the the present invention. The bit body 30 includes an uppermost threaded pin 32, whereby the bit can be connected to the lower end of a drill string. Just below pin 32, on the shank of the bit body, wrench formations 34 are provided for engagement by a suitable tool in making up or breaking out the bit from the drill string, in the well known manner. Below the shank of the bit containing wrench formations 34 is a gauge section 30 including three ribs 36 between which are located junk slots 38. At the lower end of bit body 30 is its operating end face 40. End face 40 defines three symmetrically circumferentially spaced pads 42, each of which is continuous with a respective one of the gauge ribs 36, and three recessed areas 44, each of which communicates with a respective one of the junk slots 38.

Each of the pads 42 has a further upset blade 46 extending radially therealong. As used herein, terms such as "radially," "circimferentially," and the like will refer to the bit as a whole, and its central longitudinal axis, unless otherwise noted. The bit shown in FIGS. 9 and 10 is adapted for rotation in use in the direction of arrow A in FIG. 10. Each of the blades 46 has a channel or water course 48 formed therein and extending along the length thereof. With reference to the direction A of rotation in use, each blade 46 has a fence member 50 mounted thereon adjacent the leading side of channel 48 and a row of cutting elements 52 mounted adjacent the trailing side of channel 48.

A central internal passageway 54 extends into bit body 30 from its upper or pin end. Three smaller passageways 56 extend downwardly and radially outwardly from passageway 54, each of the passageways 56 terminating in a respective opening 58 through the operating end face of the bit. Each of the openings 58 is defined by a respective nozzle member 60, and is located in a respective one of the channels 48 near the radially outer extremity thereof. This arrangement provides for a reflex type flow of drilling mud. More specifically, mud emerging from one of the openings 58 will flow radially inwardly in the respective channel 48 and then radially outwardly through one of the recessed areas 44 and thence into the respective junk slot 38.

Referring now to FIG. 11 in conjunction with FIGS. 9 and 10, each of the cutting elements 52 comprises a thin layer 62 of polycrystalline diamond carried on a thicker layer 64 of sintered tungsten carbide. The element 52 is mounted in the blade 46 so that the diamond layer 62 is exposed along the rear or trailing wall of channel 48. Each cutting element 52 has the configuration of a segment of a circle, and more specifically a semi-circle, and is disposed with its straight or rectilinear edge outermost on the blade 46. Because the backing layer 64 of sintered tungsten carbide is less hard than the diamond layer 62, the cutting element is self-sharpening, the broad exposed face of diamond layer 62 forming its cutting face, and the straight or rectilinear outer edge of layer 62 forming its cutting edge 66.

Because of the semi-circular configuration of elements 52, and the orientation with their straight edges outermost, they can be arranged in abutment so that their cutting edges form a continuous cutting edge 68 along blade 46, and more specifically, along the outermost extremity of the trailing wall of channel 48. In the embodiment shown, the cutting edges of adjacent elements are actually contiguous or abutting. In other embodiments of the invention, the elements might be slightly spaced apart, preferably with any small gaps therebetween being filled by the material of the bit body 30. However, they should be arranged so that the cutting edge along each blade 46 is generally continuous, i.e. any gaps therein do not substantially impair the ability of the row of cutting elements to form its own seal against the earth formation in use and thereby prevent substantial rearward leakage of fluid from channel 48. It is preferable that the cutting edges of the cutting elements in a row have a total length equal to at least 80% of the length of the row and/or that any gaps between adjacent cutting edges be no greater than 0.1 inch.

Still referring to FIG. 11, the fence 50 and its mounting will be described in greater detail. The fence 50 is in the form of an elongate, thin strip of flexible material, such as a natural or synthetic elastomer or a suitable flexible plastic. Other examples of suitable materials include thin metal foils, e.g. of phosphor bronze or spring steel as well as thin metallic foils.

One of the long edges 70 of fence 50 is mounted in an elongate recess 72 in the leading wall of channel 48, as by bonding or in any other suitable manner. The other long edge 74 is free to project outwardly from the bit body at least slightly farther than the cutting edge 66. Outwardly of recess 70, the leading wall of channel 48 is inclined rearwardly, as shown in FIG. 11, to partially support the fence 50 and to complement the tendency of fence 50 to trail rearwardly in use, as explained more fully below.

The fence 50 is sufficiently flexible that it will not be plastically deformed by the forces expected in use, nor will it exert any great force of its own against the formation, as do the relatively stiff brush style fences of the preceding embodiments. Thus, in use, and in the absence of a positive pressure differential across fence 50 in the rear to front direction, the free end 74 of the fence will ride loosely over the earth formation. However, in the presence of such a positive pressure differential, i.e. when the pressure within channel 48 is greater than the pressure forward of blade 46, fence 50 will act a self-actuating seal against the earth formation.

As shown in FIG. 12, because the direction of motion of the bit in use is in the direction of arrow A, free edge 74 of fence 50 will trail rearwardly as shown, forming a rearwardly extending lip. Then, if the pressure in channel 48 is greater than the pressure in front of blade 46, the pressure within channel 48 will bear against the rearwardly trailing lip formed by fence 74, thereby urging fence 74 into sealing engagement with the earth formation 76. In other words, the very pressure being sealed against will cause the seal to form. FIG. 12 illustrates the fence in use, but with a relatively small pressure differential across fence 50 in the rear-to-front direction.

Because of the self-actuating nature of the seal formed by fence 50, the seal will automatically tighten in response to an increase in the pressure differential thereacross. FIG. 13 shows the condition of the fence when the pressure differential is quite high, e.g. when there is a blockage in channel 48. As the pressure of the drilling fluid in channel 48 increases due to the blockage, that pressure urges fence 50 into tighter and tighter sealing engagement with the earth formation 76, so that the tightness of the seal is self-adjusting to accommodate the pressure increase. As shown in FIG. 13, a relatively high pressure differential will urge the inner portion of fence 50 against the leading wall of channel 48 and will also urge the free trailing portion of the fence tightly against the earth formation 76, forming a true lip.

Maintenance of such a seal is important in the case of blockage in channel 48 because, if the pressure in that channel can be allowed to increase, it will, in many instances, clear the blockage with a flushing action. After such clearing, the pressure differential across the fence will drop, and the fence will resume the configuration of FIG. 12, wherein it is exerting much less force against the earth formation 76 and, therefore, is less susceptible to wear.

As explained above, the self-actuating seal action of fence 50 is closely related to the fact that, in use, its free edge 74 trails rearwardly to form a lip against which the pressure in channel 48 can bear in order to tighten the seal. In the embodiment just described, the formation of a rearwardly trailing lip is a function of the flexibility of the fence 50 coupled with the direction of movement of the bit in use as the fence 50 rides over the formation. Other embodiments are possible.

For example, FIG. 14 shows a variation in which the fence 78 is formed of a strip of more rigid material, e.g. a suitable metal or synthetic material. In order to ensure a self-actuating seal, while also ensuring that the fence 78 does not exert a great force of its own against the formation in the absence of a rear-to-front pressure differential thereacross, the outer or free portion of fence 78 is bent or preformed to create the rearwardly trailing lip **78*a*. Lip 78*a* is positioned so that it does not protrude beyond the opposed cutting edge 66'. Thus, in use, it will ride loosely over the formation, even clearing it slightly, in the absence of a pressure differential rear-to-front across the fence. While rigid enough to be self-supporting in this preformed configuration, the fence 78 is nevertheless flexible enough to respond to a pressure differential thereacross and move into tighter sealing engagement with the formation in response to pressure in channel 48**.

FIGS. 15 and 16 show how the invention can be applied to a bit having a more conventional radially outward mud flow pattern, as contrasted with the reflexive pattern of the bit of FIGS. 9 and 10. To the extent that the bit of FIGS. 15 and 16 is identical to that of FIGS. 9 and 10, like parts have been given like reference numerals, and will not be described in detail.

The bit body has a central passageway 80, longer than passageway 54 of the preceding embodiment, the three smaller passageways 82 which communicate with passageway 80 lead to nozzles 84 which communicate with respective channels 88 in the operating end face of the bit, but near the radially inner extremities of these channels, rather than at the radially outward extremities. Each nozzle 84 defines an opening 86 in a respective such channel 88. The channels 88 extend radially along respective blades 90 on the operating end face 92 of the bit body. Thus, mud flows radially outwardly through each channel 88, and thence into a respective junk slot 94 communicating therewith and extending along the gauge section of the bit.

Additional slots 96 extend through the gauge section and communicate with the operating end face of the bit. Slots 96 prevent swabbing, sticking or other problems as the bit is moved in or out of the borehole. The rows of cutting elements 52 in the trailing walls of the channels 88, and the fences 90 on the corresponding leading walls, are identical to the corresponding elements of the embodiment of FIGS. 9 et. seq., and a section taken on the line B-B in FIG. 16 would be identical to FIG. 11 except for certain reference numerals.

Other embodiments of the invention are possible. For example, FIG. 11 illustrates an extremely flexible fence 50, while FIG. 14 illustrates a relatively stiff fence. Intermediate degrees of flexibility are possible, as long as the fence is designed, in one way or another, to ride relatively loosely over the formation in the absence of a pressure differential rear-to-front (i.e. not to exert a strong force of its own against the formation), but to sealingly engage the formation in the presence of such pressure differential, with the tightness of the sealing engagement increasing with increases in such pressure differential. Likewise, while two bit styles have been shown, this aspect of the invention could be applied to numerous other bit styles. Still other variations, within the spirit of the invention, will suggest themselves to those of skill in the art. It is therefore intended that the scope of the invention be limited only by the following claims.

What is claimed is:

1. A rotary drill bit, for drilling wells in subsurface earth formations, and designed for rotation in a given direction, comprising:

a bit body having an internal passageway for drilling fluid, an operating end face, and at least one opening through said operating end face communicating with said passageway;

cutting means on said bit body forming at least one elongate cutting region extending generally radially along a substantial portion of said operating end face, said cutting region having cutting surface means facing in a forward direction with respect to said direction of rotation and generally continuous cutting edge means at the other extremity of said cutting surface means;

said cutting means comprising a plurality of cutting elements arranged in a row along said cutting region, each of said cutting elements having an outer cutting edge, said outer cutting edges jointly forming said cutting edge means and the total combined length of said outer cutting edges in said row equalling at least 80% of the overall length of the row;

a flexible elongate fence carried on said bit body, extending generally parallel to said cutting region, and spaced from said cutting region in a leading direction;

said at least one opening being positioned to deliver drilling fluid from said passageway to the area between said cutting region and said fence.

2. A bit according to claim 1 wherein each of said cutting elements comprises a thin layer of hard material lying transverse to said direction of rotation, said layers of hard material jointly forming said cutting surface means, and the outer edges of said layers of hard material jointly forming said cutting edge means.

3. A bit according to claim 2 wherein each of said cutting elements further comprises a backing layer of less hard material in trailing relation to said layer of hard material, whereby the cutting element is self-sharpening.

4. A bit according to claim 1 wherein said outer edges of the cutting elements in said row are not spaced apart by more than 0.1 inch.

5. A bit according to claim 1 wherein said outer edge of each of said cutting elements is generally rectilinear.

6. A bit according to claim 5 wherein each of said cutting elements has the configuration of a segment of a circle.

7. A bit according to claim 1 wherein said fence comprises a continuous strip of flexible material with one long edge mounted on said operating end face and the other long edge projecting outwardly from said operating end face.

8. A bit according to claim 7 wherein said fence is sized and positioned so that said other long edge may project from said operating end face beyond said cutting edge means.

9. A bit according to claim 8 wherein said fence is adapted to ride loosely over the earth formation in use and in the absence of a positive pressure differential across said fence rear-to-front, and to more tightly engage said earth formation in the presence of such positive pressure differential, the tightness of engagement increasing with said pressure differential.

10. A bit according to claim 1 wherein said operating end face defines an inset channel between and generally parallel to said cutting region and said fence.

11. A bit according to claim 1 wherein said at least one opening opens into said channel.

12. A bit according to claim 1 wherein there are a plurality of such cutting regions, each having a respective such fence associated therewith, and a plurality of such openings.

13. A bit according to claim 12 wherein the distance between each of said cutting regions and its respective associated fence is less than half the distance between said cutting region and the nearest adjacent cutting region, at least in the radially outer portions of said cutting regions and said fence.

14. A rotary drill bit, for drilling wells in subsurface earth formations, and designed for rotation in a given direction comprising:

a bit body having an internal passageway for drilling fluid, an operating end face, and at least one opening through said operating end face communicating with said passageway;

cutting means on said bit body forming at least one elongate cutting region extending generally radially along a substantial portion of said operating end face, said cutting region having cutting surface means facing in a forward direction with respect to said direction of rotation and generally continuous cutting edge means at the outer extremity of said cutting surface means;

said cutting means comprising a plurality of cutting elements arranged in a row along said cutting region, each of said cutting elements having an outer cutting edge, said outer cutting edges jointly forming said cutting edge means and the total combined length of said outer cutting edges in said row equalling at least 80% of the overall length of the row;

an elongate fence carried on said bit body, extending generally parallel to said cutting region, and spaced from said cutting region in a leading direction, said fence being adapted to ride loosely over the earth formation in use and in the absence of a positive pressure differential across said fence rear-to-front, and to more tightly engage said earth formation in the presence of such positive pressure differential, the tightness of engagement increasing with said pressure differential;

said at least one opening being positioned to deliver drilling fluid from said passageway to the area between said cutting region and said fence.

15. A bit according to claim 14 wherein said frame has an inner portion mounted on said operating end face and an outer portion which is free of said bit body, said outer portion, in use, defining a lip trailing rearwardly toward said cutting region.

16. A bit according to claim 14 wherein each of said cutting elements comprises a thin layer of hard material lying transverse to said direction of rotation, said layers of hard material jointly forming said cutting surface means, and the outer edges of said layers of hard material jointly forming said cutting edge means.

17. A bit according to claim 16 wherein each of said cutting elements further comprises a backing layer of less hard material in trailing relation to said layer of hard material, whereby the cutting element is self-sharpening.

18. A bit according to claim 14 wherein the outer edges of the cutting elements in said row are not spaced apart by more than 0.1 inch.

19. A bit according to claim 18 wherein said outer edge of each of said cutting elements is generally rectilinear.

20. A bit according to claim 19 wherein each of said cutting elements has the configuration of a segment of a circle.

* * * * *

UNITED STATES PATENT AND TRADEMARK OFFICE

CERTIFICATE OF CORRECTION

PATENT NO. : 4,727,946

DATED : March 1, 1988

INVENTOR(S) : John D. Barr and Terry R. Matthias

It is certified that error appears in the above-identified patent and that said Letters Patent is hereby corrected as shown below:

In column 11, line 14, delete "frame" and insert therefor --fence--.

Signed and Sealed this

Twentieth Day of September, 1988

*Attest:*

*Attesting Officer*

DONALD J. QUIGG

*Commissioner of Patents and Trademarks*